United States Patent [19]

Matsubara

[11] Patent Number: 4,986,157

[45] Date of Patent: Jan. 22, 1991

[54] ELECTRONIC MUSICAL INSTRUMENT WITH A FRET-SPLIT FUNCTION

[75] Inventor: Akinori Matsubara, Tachikawa, Japan

[73] Assignee: Casio Computer Co., Ltd., Tokyo, Japan

[21] Appl. No.: 448,808

[22] Filed: Dec. 11, 1989

[30] Foreign Application Priority Data

Dec. 28, 1988 [JP] Japan ..... 63-332112[U]

[51] Int. Cl.[5] ..... G10D 3/06; G10D 1/08

[52] U.S. Cl. ..... 84/646; 84/722; 84/659

[58] Field of Search ..... 84/645, 646, 722, 723, 84/735, 736, DIG. 30

[56] References Cited

U.S. PATENT DOCUMENTS

| | | | |
|---|---|---|---|
| 4,339,979 | 7/1982 | Norman | 84/DIG. 30 |
| 4,372,187 | 2/1983 | Berg | 84/722 |
| 4,658,690 | 4/1987 | Aitken et al. | 84/629 |
| 4,723,468 | 2/1988 | Takabayashi et al. | 84/722 |
| 4,817,484 | 4/1989 | Iba et al. | 84/735 |

FOREIGN PATENT DOCUMENTS

| | | |
|---|---|---|
| 60-501276 | 8/1985 | Japan . |
| 62-99790 | 5/1987 | Japan . |
| 63-136090 | 6/1988 | Japan . |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

The present invention relates to an electronic musical instrument with a fret-split function, which is used in electronic stringed instruments such as an electronic guitar, electronic violin, guitar synthesizer. Fingering areas provided on a finger-board are divided on the basis of a particular fret among a plurality of frets provided on the fingering areas. Specific tone colors are assigned to these fingering areas thus divided, respectively. Fingering operation on fingering areas to which specific tone colors are assigned allows to generate a musical tone having a tone color previously assigned.

16 Claims, 4 Drawing Sheets

ELECTRONIC MUSICAL INSTRUMENT WITH A FRET-SPLIT FUNCTION

BACKGROUND OF THE INVENTION

1. Field of the Invention

The present invention relates to an electronic musical instrument which is effectively applied to electronic stringed instruments such as, for example, an electronic guitar, electronic violin, guitar synthesizer, and the like. More particularly, it relates to an electronic musical instrument having a fret-split function which is capable of assigning specific tone colors to fingering areas, respectively, divided on the basis of frets as boundaries.

2. Description of the Related Art

In the field of electronic stringed instruments, electronic stringed instruments with a string-split function are well known in the art. In this type of electronic stringed instruments, a specific tone color is previously assigned to each string or to a plurality of strings, and when a certain string is plucked, musical tones are generated in response to plucking operation, which have the tone color assigned to the plucked string. With use of these electronic stringed instruments, in which different tone colors are assigned to respective strings from the first string to the sixth string, musical tones each having a different tone color can be successively generated by plucking the strings successively in order from the first string to the sixth string.

In these electronic stringed instruments, however, a specific tone color is assigned to each string or to particular strings. Therefore, when a musician plays the instrument with a stroke-performance, or when the musician rapidly plucks the strings in order from the first string to the sixth string or reversely in order from the sixth string to the first string, strings shall generate musical tones each having a tone color assigned to the corresponding string or assigned to particular strings. Accordingly, when the musician plucks a plurality of strings at the same time or sequentially to execute a chord-performance, musical tones shall be generated, which have different tone colors which correspond to tone pitches composing the chord. As a result, a problem remains that musically unfavourable musical tones are generated.

Meanwhile, some electronic keyboard musical instruments with a key-split function are well known, in which keys on the keyboard are divided into two groups such as a lower tone-pitch key group and a higher tone-pitch key group on the basis of a key representing a particular tone pitch, and different tone colors are assigned to these key groups, respectively, and thereby keys belonging to these lower and higher tone-pitch key groups generate musical tones having different tone colors, respectively.

However, it is difficult to apply the technique relating to such a key-split function without any modification to electronic stringed instruments. More specifically, in a conventional stringed instrument, a group of musical scales assigned to each string are differently arranged on a finger-board. For example, in a six-string guitar, a tone pitch assigned to an open-string fret position of the first string is the tone pitch $E_4$, a tone pitch assigned to the same position of the second string is the tone pitch $B_3$, a tone pitch assigned to the same position of the third string is the tone pitch $G_3$, a tone pitch assigned to the same position of the fourth string is the tone pitch $D_3$, a tone pitch assigned to the same position of the fifth string is the tone pitch $A_2$ and a tone pitch assigned to the same position of the sixth string is the tone pitch $E_2$. A group of musical scales are assigned to respective frets of each string on the basis of the above tone pitches, $E_4$, $B_3$, $G_3$, $D_3$, $A_2$ and $E_2$. Accordingly, there shall be assigned a plurality of same tone pitches (for example, the tone pitch $C_4$) within a specific fingering area, or within, for example, a specific fingering area confined between the first fret position and the seventh fret position. Therefore, if a split position, on the basis of which tone colors are assigned is set to a specific tone pitch position, for example, the position of the tone pitch $D_4$, and if different tone colors are assigned to frets located within a higher tone-pitch area and a lower tone-pitch area, which are divided by the above position of the tone pitch $D_4$, then different tone colors shall be assigned to the position of the tone pitch $C_4$ and to the positions of the tone pitches $E_4$, $G_4$, respectively. As a result, such a problem will arise that when the musician stops strings within a relatively narrow fingering area between the first fret and the seventh fret to play C major chord, the C major chord composed of tone-pitches $C_4$, $E_4$ and $G_4$ can not be produced with the same tone color.

SUMMARY OF THE INVENTION

The present invention has been made in order to overcome the prior art problems described above, and it has an object of providing an electronic musical instrument, in which a fingering area on a fingering-board is divided into a higher tone-pitch area and a lower tone-pitch area on the basis of a particular fret position, and which is capable of assigning specific tone colors to the higher and lower tone-pitch areas, respectively.

Another object of the invention is to provide an electronic musical instrument, in which a fingering area on a fingering-board is divided into a higher tone-pitch area and a lower tone pitch area by a particular fret position as a boundary and specific tone colors are assigned to these higher and lower tone-pitch areas, respectively, and which is capable of producing musical tones having the specific tone colors thus assigned, in response to string vibration.

Still another object of the present invention is to provide an electronic musical instrument, in which a fingering area on a fingering-board is divided into a higher tone-pitch area and a lower tone-pitch area on the basis of a particular fret position, and which is capable of assigning, selectively different kinds of tone colors or same kind of tone colors to those higher and lower tone-pitch area.

According to one embodiment of the present invention, there is provided an electronic musical instrument comprising:

a finger-board having a plurality of fingering areas which are arranged in parallel;

a plurality of frets provided on said finger-board, and arranged at predetermined intervals and at right angles to the longitudinal direction of said fingering areas;

tone-pitch designating means for designating tone pitch corresponding to fret positions where fingering operation is executed, in response to fingering operation on said frets; and tone-color assigning means for dividing said fingering areas on the basis of one or more particular frets among a plurality of said frets and for assigning same or different tone colors to the divided fingering areas, respectively.

The term used above "fingering area" means an area where a fingering operation is executed by a musician and also means, in general, a certain conceptual area which extends along the longitudinal direction of the finger-board. The term "fret" usually means a parting projection provided on the finger-board at right angles to the longitudinal direction of the finger-board, but "fret" is not always a parting projection. For instance, the fret may be a groove, line, or mark provided on the finger-board and also the fret may be a certain mark which a violinist imagines on the finger-board.

According to other embodiment of the present invention, there is provided an electronic musical instrument comprising:

a finger-board having a plurality of fingering areas which are arranged in parallel;

a plurality of frets provided on said finger-board, and arranged at predetermined intervals and at right angles to the longitudinal direction of said fingering areas;

tone-pitch designating means for designating tone pitches corresponding to fret positions where fingering operation is executed, in response to fingering operation on said frets;

tone-color assigning means for dividing said fingering areas on the basis of one or more particular frets among a plurality of said frets and for assigning same or different tone colors to the divided fingering areas, respectively;

strings extended longitudinally along said fingering areas, respectively;

string vibration detecting means for detecting vibrations of said respective strings; and control means for controlling to cause to generate a musical tone having one of the tone colors assigned to said fingering areas by said tone-color assigning means, in response to the vibration detected by said string-vibration detecting means.

The above mentioned "strings" may be provided in opposition to the above "fingering areas". Hence, the "strings" may be provided phisically separately over "fingering areas", or the "strings" may be extended on the "fingering areas".

Further, according to still other embodiments of the present invention, there is provided an electronic musical instrument comprising:

a finger-board having a plurality of fingering areas which are arranged in parallel;

a plurality of frets provided on said finger-board, and arranged at predetermined intervals and at right angles to the longitudinal direction of said fingering areas;

tone-pitch designating means for designating tone pitches corresponding to fret positions where fingering operation is executed, in response to fingering operation on said frets;

tone-color assigning means for dividing said fingering areas on the basis of one or more particular frets among a plurality of said frets and for assigning same or different tone colors to the divided fingering areas, respectively; and selection means for deciding whether said tone-color assigning means assigns different tone colors to said fingering areas, respectively or said tone-color assigning means assigns the same kind of tone color to said respective fingering areas.

Furthermore, according to yet another embodiment of the present invention, there is provided an electronic musical instrument comprising:

a finger-board having a plurality of fingering areas which are arranged in parallel;

a plurality of frets provided on said finger-board, and arranged at predetermined intervals and at right angles to the longitudinal direction of said fingering areas;

tone-pitch designating means for designating tone pitches corresponding to fret positions where fingering operation is executed, in response to fingering operation on said frets;

tone-color assigning means for dividing said fingering areas on the basis of one or more particular frets among a plurality of said frets and for assigning same or different tone colors to the divided fingering areas, respectively; and setting means for setting a position of said particular fret.

DETAILED DESCRIPTION OF THE PREFERRED EMBODIMENT

Now, an electronic stringed instrument according to an embodiment of the present invention will be described with reference to the drawings.

Figure 1A:
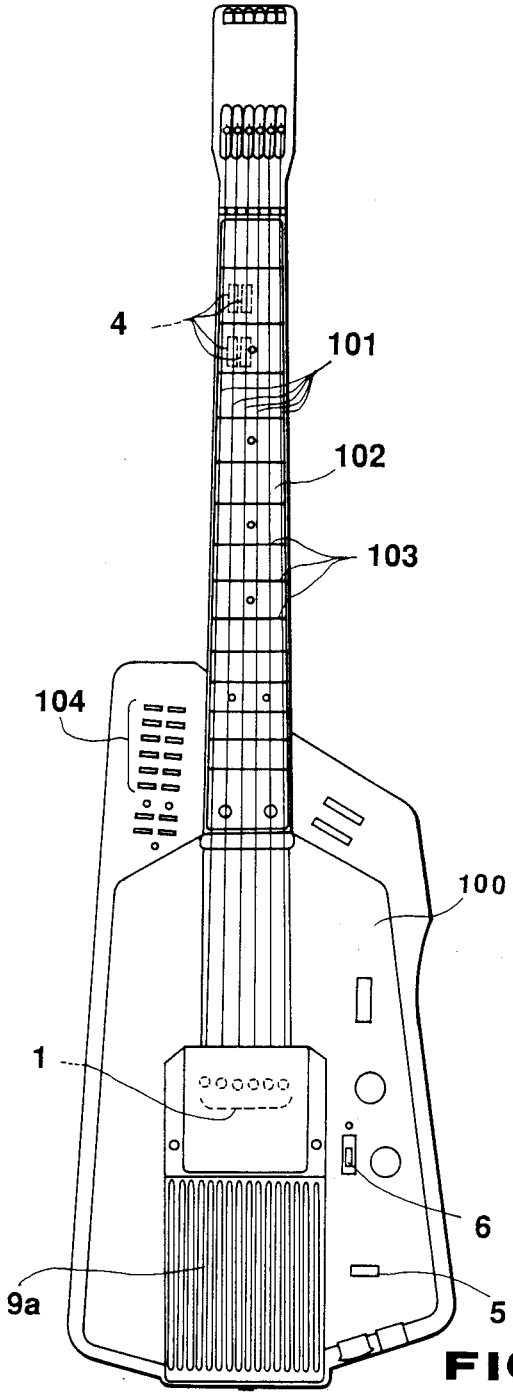
FIG. 1A is a plane view showing an electronic stringed instrument to which an electronic musical instrument according to the present invention is applied.
Figure 1B:
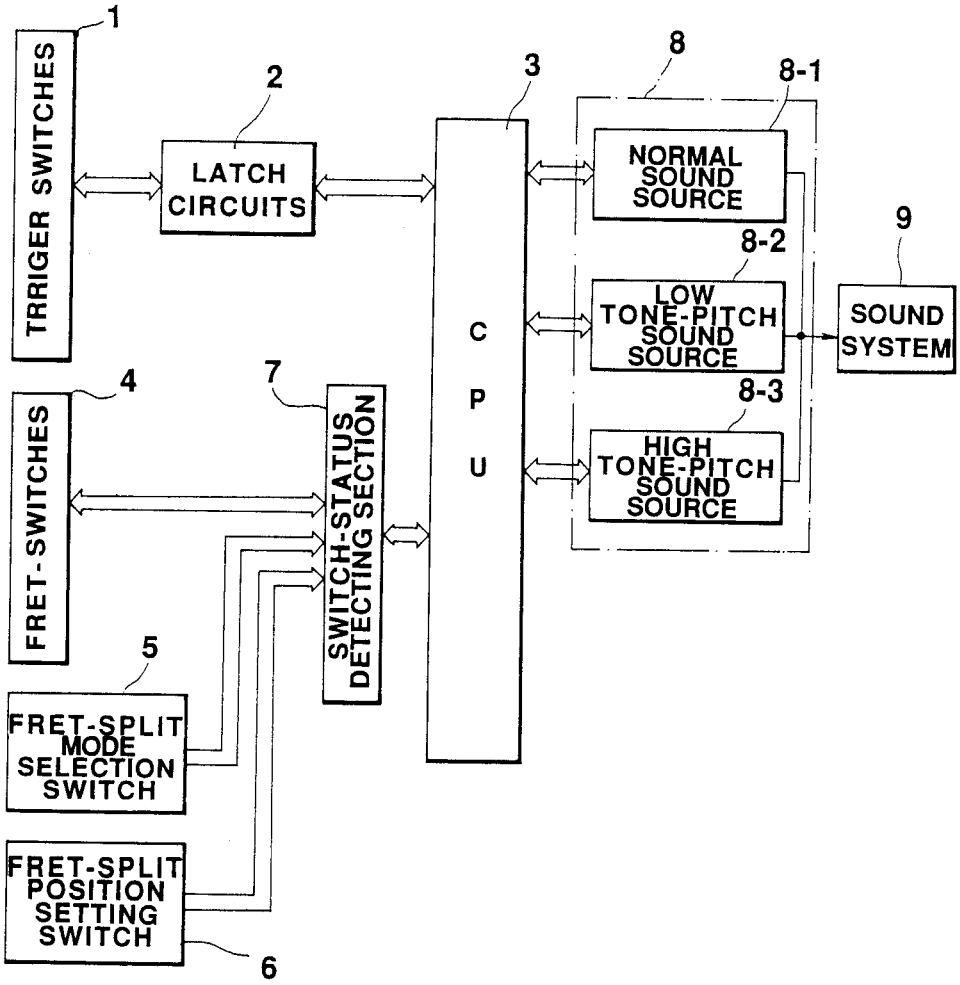
FIG. 1B is a whole circuit diagram of the above electronic stringed instrument.

FIG. 1A is a plane view showing the electronic stringed instrument. FIG. 1B is a block diagram of a whole circuit used in the electronic musical instrument.

When some of six strings 101 expanded over a stringed instrument body 100 are plucked, particular trigger switches 1 among a group of trigger switches 1, which are provided in opposition to the plucked strings 101 are turned on. Note that, for example, a trigger switches 1 disclosed in U.S. patent application Ser. No. 069,612 may be used as the above trigger switch. Then, latch circuits 2 (for example, circuits composed of a flip-flop circuit as a latching element) respectively connected to the trigger circuits which have been turned on are set. A central processing unit of a microprocessor, CPU3 samples contents latched in the latch circuits 2 and compares them with values previously sampled, thereby determining which strings have started vibration. In response to the above determination of the string, CPU3 outputs string-trigger data, which instructs a musical tone generating circuit 8 to start on generation of a musical tone. There are provided a number of frets on a finger-board 102 of the stringed instrument body 100. The body 100 is also provided with fret switches 4 composed of a number of fret switches which are laid in a matrix arrangement under the above frets 103. The above frets serve as marks for designation of a one pitch of a musical tone to be generated. When a string is stopped against the finger-board 102, a fret switch corresponding to a fret position which is designated by the above stopping operation is turned on. Note that the fret switch disclosed in the above described U.S. patent application Ser. No. 069,612 can be used as the above fret switch.

Further, the stringed instrument body 100 is provided with a fret-split mode selection switch 5, a fret-split position setting switch 6 and a tone-color selection switch 104. The fret-split mode selection switch 5 is used to select a fret-split mode, in which a fret-split function works to assign different tone colors to fingering areas divided on the basis of a particular fret 103, respectively, or a normal mode in which the fret-split function does not work. The fret-split position setting switch 6 serves to set a fret-split position which decides a fret position 103, i.e., a boundary between fingering areas to which different tone colors are assigned, respectively The tone-color selection switch 104 is operated to select a tone color to be assigned to each fingering area, ON and OFF states or operations of the above switches 5, 6 are detected by a switch-status detecting section 7 and are read in CPU3. CPU3 controls the musical tone generating circuit 8 on the basis of data from the latch circuits 2 and the switch-status detecting section 7, and it causes the circuit 8 to generate a musical tone having a corresponding tone color The musical tone is audibly output through a sound system 9 composed of an amplifier and a speaker 9*a*. The musical tone generating circuit 8 is composed of a normal sound source 8-1 used in a normal performance state where a fret-split function is prevented from working, a low tone-pitch sound source 8-2 used in a fret-split state where the fret-split function is allowed to work, and a high tone-pitch sound source 8-3. All of these sound sources generate musical tone signals each having a predetermined tone color under control of CPU3.

Figure 2:
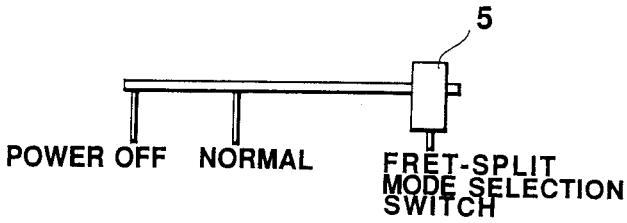
FIG. 2 is a view showing a fret-split mode selection switch.

FIG. 2 is a function view for describing the function of the above mentioned fret-split mode selection switch 5 provided on the surface of the electronic stringed instrument body 100. The fret-split mode selection switch 5 also serves as a power switch. When the fret-split mode selection switch 5 is brought to a power-off position, then the power supply to the instrument 100 ceases and when it is brought to a normal position, the above mentioned normal mode is set. Further, when the fret-split mode selection switch 5 is switched to a fret-split position, the fret-split mode shall be set.

The operation of the electronic stringed instrument will be described with reference to the main processing operation of CPU3, which functions as a split-assignment setting device.

Figure 3:
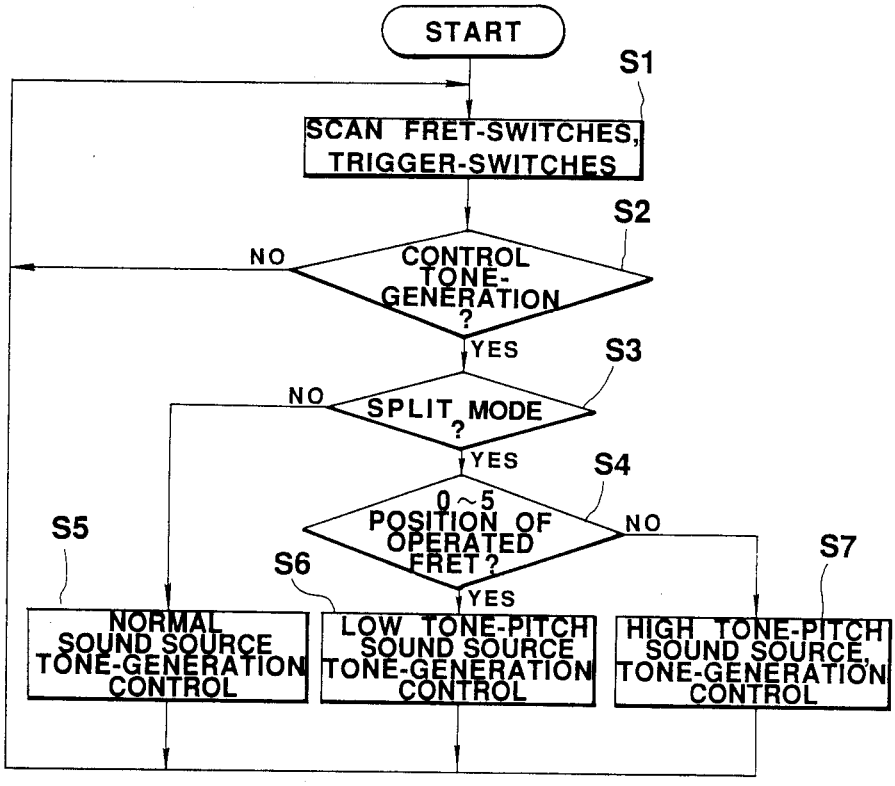
FIG. 3 is a flow chart showing the operation of the present invention.

FIG. 3 is a flow chart showing the controlling process of the musical tone generation in CPU3. The flow of the process starts when a timer interruption takes place in a main flow (not shown) or when an operation is repeated at a predetermined timing. To start with, ON-OFF state of a group of trigger-switches 1 and also ON-OFF state of a group of fret switches 4 are scanned at step S1. A check is executed at step S2 as to whether string-trigger data is detected and the process is in the state of controlling generation of a musical tone. If the check results in "NO", the process returns to step S1 to continue a loop process, since it is not necessary to control generation of a musical tone. If the check results in "YES", a check is executed at step S3 as to whether the fret-split mode has been set by operation of the fret-split mode selection switch 5. If the check results in "NO", CPU3 sends at step S5 a control instruction to the normal sound source 8-1 in the musical tone generating circuit 8 to cause the same to generate a musical tone having a normal tone color previously selected by a tone-color selection switch (not shown). Then the process returns to step S1. If the check at step S3 results in "YES", the fret-split function is operable, and then a check is executed as to on which fret position from the zero fret position (open string fret position) to the fifth fret position a player of the musical instrument executes fingering operation.

Now, it is assumed that the fifth fret position is set as the split position by the fret-split position setting switch 6. When a fret position which is located in the tone-pitch area between a head and the sixth fret position has been fingered by the player, the low tone-pitch sound source 8-2 of the musical tone generating circuit 8 generates a musical tone having a corresponding tone color. When a fret position which is located in the tone-pitch area between the fifth fret position and a bridge has been fingered, the high tone-pitch sound source 8-3 generates a musical tone having a tone color different from that assigned to fret positions in the low tone-pitch area. Accordingly, if the check at step S4 results in "YES", CPU3 sends at step S6 a control instruction to the low tone-pitch sound source 8-2 to cause the same to generate a musical-tone waveform having a predetermined tone color. Meanwhile, if the check at step S4 results in "NO", CPU3 sends at step S7 a control instruction of the high tone-pitch sound source 8-3 to cause the same to generate a musical-tone waveform having a predetermined tone-color different from the above tone-color. In any case, the process returns to step S1 to repeat the processes of steps S1 through S7.

Figure 4:
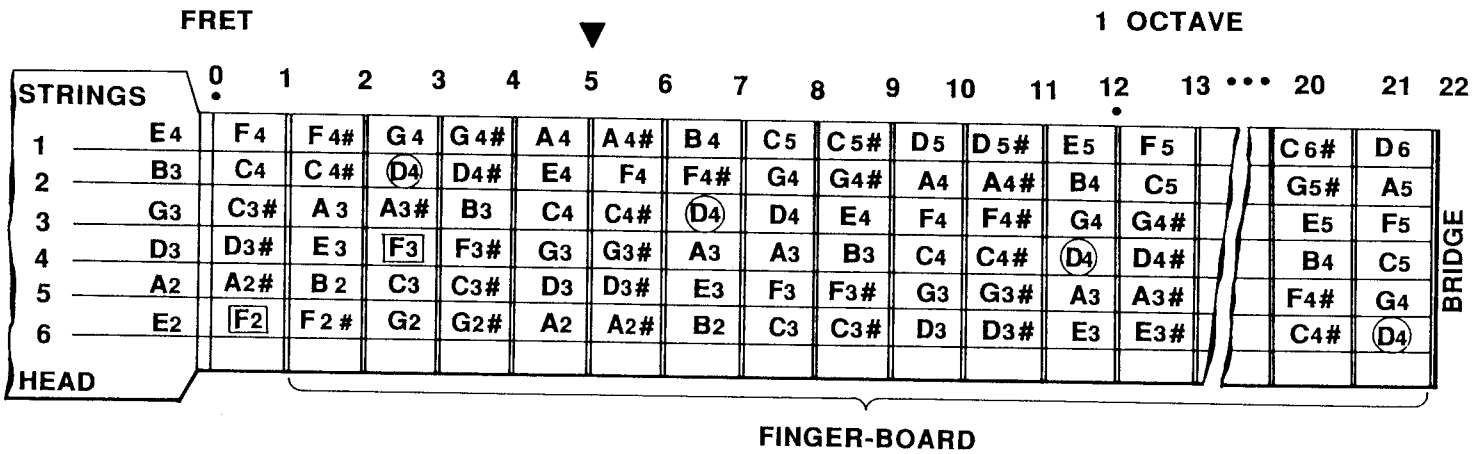
FIG. 4 is a view showing tone scales assigned on a finger-board.

As described above, in the embodiment of the present invention, the split-fret state is not set on the basis of a particular tone-pitch position but it is set on the basis of a fret position. Therefore, the present embodiment has following advantages, which will be described with reference to FIG. 4. Now, it is assumed that, for example, the fifth fret position of FIG. 4 is set as the split position. Then, a tone color set to the low tone-pitch sound source 8-2 shall be assigned, in common to the respective strings, to a fingering area of a lower tone-pitch side between the zero fret position or the open-string fret position and the fifth fret position, while a tone color set to the high tone-pitch sound source 8 3 shall be assigned to a fingering area of a higher tone pitch side between the sixth fret position and the bridge. For instance, when the player tries to make a performance by alternatively stopping a tone pitch $F_2$ and a tone pitch higher than the $F_2$ by one octave, the player is required only to alternatively stop the sixth string at the first fret position ($F_2$) and the fourth string at the third fret position ($F_3$). The distance between both stopping positions is very short and three or four cm. long, so that the player is not required to move his wrist. For instance, within a tone pitch area confined or fret-splited by the fifth fret, the musician can easily execute an octave performance with a predetermined same tone color by stopping the sixth string at the fifth fret with his index finger and the fourth string at the third fret with his ring finger.

In case that a group of scales are assigned to respective strings tunned by the conventional string-tunning method, following scales are assigned to respective six strings from the first string to the sixth string as shown in FIG. 4. More specifically, tone pitches are assigned to respective strings at the open-string fret position as follows: $E_4$ to the first string, $B_3$ to the second string, $G_3$ to the third string, $D_3$ to the fourth string, $A_2$ to the fifth stirng and $E_2$ to the six string. Accordingly, for instance, tone pitches of respective strings at the 22nd fret position shall be given as follows: $D_6$ to the first string, $A_5$ to the second string, $F_5$ to the third string, $C_5$ to the fourth stirng, $G_4$ to the fifth string and $D_4$ to the sixth string. When tone pitches are assigned to frets as described above, the same tone pitches can be designated at a plurality of fret positions at the same time in the embodiment differing from key-board instruments mentioned above. For instance, the tone pitch $D_4$ can be obtained not only at the 22nd fret position of the sixth string but also at five other fret positions as marked with circles O in FIG. 4, such as the 17th fret position (not shown) of the fifth string, the 12th fret position of the fourth string, the 7th fret position of the third string and the third fret position of the second string. Accordingly, when, as in the above described embodiment, different tone colors are assigned to respective fingering areas of a higher tone pitch side and a lower tone pitch side on the basis of a particular fret position such as the fifth fret position, tone pitches $A_2$# through $A_4$ exist both in the fingering area of a higher tone pitch side and in the fingering area of a lower tone pitch area. Therefore, the tone pitches $A_2$# through $A_4$ can be generated with any of tone colors, which have been assigned to the lower tone pitch area and the higher tone pitch area, respectively.

Moreover, according to the so-called "key split" in key-board musical instruments, a tone color A is assigned to a key-operation area of a lower tone-pitch side including tone pitches, for example, $E_2$ through $A_4$ and another tone color B is assigned to another key-operation area of a higher tone-pitch side including tone pitches $A_4$# through $D_6$ on the basis of a key representing a particular tone pitch, however, in the present embodiment, differing from the above "key split", a fingering (fret operation) area is divided on the basis of a particular fret and specific tone colors are assigned to the fingering areas thus divided, respectively. Therefore, a plurality of split positions (e.g., fret positions representing a tone pitch $D_4$) do not exist in a special fingering area. In the present embodiment, the split position is set on the basis of a fret position and as a result, the player can play the instrument, clearly recognizing the split position Furthermore, in the present embodiment, when the player executes the so-called stroke-performance (plucking the strings sequentially in order from the first string to the sixth string or in order from the sixth string to the first string) in a particular fingering area such as, for instance, the fingering area of the lower tone pitch side between the open string fret position and the sixth fret position, it is possible to prevent generation of musical tones having different tone colors due to different string plucking.

In the above embodiment, string trigger data for controlling of commencement of musical-tone generation is output on the basis of ON.OFF operation of the trigger switches 2, but the above data may be output on the basis of an electric signal instead of the above ON.-OFF operation of the trigger switches 2, which electric signal is generated from a pick-up device of an electromagnetic type, optical type, condenser type or piezoelectric type, that detects vibration of a plucked string.

Furthermore, in the above embodiment, string-stopping positions or fret-operation positions are detected by a plurality of fret switches provided in a matrix arrangement, but this is not limitative. For instance, for detection of fret-operation positions, it is possible to use the so-called "pitch extracting system", disclosed in, for example, U.S. Pat. No. 112,780, the counter part of Japanese Patent Disclosure TOKKAISHO 63-136090, which extracts a pitch from string vibration of a plucked string and determines the fret position corresponding to the extracted pitch, and "a super-sonic wave system", disclosed in, for example, U.S. Pat. No. 4,723,468, a counter part of Japanese Patent Disclosure, TOKKAISHO 62-99790, which transmits a super-sonic wave to strings and receives echo reflected from a fret position where a fret and a string are caused to contact each other and detects the fret position by measuring a traveling time of the echo. Further, "a string current supply system", disclosed in, for example, U.S. Pat. No. 4,658,690, a counter part of Japanese Patent Disclosure, TOKKAISHO 60-501276, may be used to detect the fret-operation position, in which system a very small amount of current is supplied to strings and a fret position is detected by a fret which is supplied with current when it contacts the string.

What is claimed is:

1. An electronic musical instrument comprising:

a finger board having a plurality of fingering areas which are arranged in parallel;

a plurality of frets provided on said finger-board, and arranged at predetermined intervals and at right angles to the longitudinal direction of said fingering areas;

tone-pitch designating means for designating a tone pitch corresponding to fret position where fingering operation is executed, in response to fingering operation on said plurality of frets; and tone-color assigning means for dividing said fingering areas on the basis of one or more particular frets among a plurality of said frets and for assigning same or different tone colors to the divided fingering areas, respectively.

2. An electronic musical instrument according to claim 1, further comprising:

strings extended longitudinally along said fingering areas, respectively;

string-vibration detecting means for detecting vibrations of said respective strings; and control means for controlling to cause to generate a musical tone having one of the tone colors which said tone-color assigning means assigns to said fingering areas, in response to the vibration detected by said string-vibration detecting means.

3. An electronic musical instrument according to claim 1, further comprising:

selection means for deciding whether said tone-color assigning means assigns different tone colors to said fingering areas, respectively or said tone-color assigning means assigns the same kind of tone color to said respective fingering area.

4. An electronic musical instrument according to claim 1, further comprising:

setting means for setting a position of said particular fret.

5. An electronic musical instrument comprising:

a finger-board having a plurality of fingering areas arranged in parallel;

a plurality of frets provided on said finger-board, and arranged at right angles to the longitudinal direction of said fingering areas, and further disposed in accordance with musical-scales which are arranged in different disposal on respective fingering areas;

tone-pitch designating means for designating a tone pitch corresponding to a fret position on which fingering operation is executed, in accordance with said musical-scale arrangement, when the fingering operation is executed on said plurality of frets; and tone-color assigning means for dividing said fingering areas on the basis of a particular fret among said plurality of frets, and for assigning specific tone colors to the divided fingering area, respectively.

6. An electronic musical instrument according to claim 5, further comprising:

strings extended longitudinally along said fingering area, respectively;

string-vibration detecting means for detecting vibrations of said respective strings; and control means for controlling to cause to generate a musical tone having one of the tone colors which said tone-color assigning means assigns to said fingering areas, in response to the vibration detected by said string-vibration detecting means.

7. An electronic musical instrument according to claim 5, further comprising:

selection means for deciding whether said tone-color assigning means assigns different tone colors to said fingering area, respectively or said tone-color assigning means assigns the same kind of tone color to said respective fingering area.

8. An electronic musical instrument according to claim 5, further comprising:

setting means for setting a position of said particular fret.

9. An electronic musical instrument comprising:

a finger-board having a plurality of fingering areas;

at least one string extended over said finger-board;

a plurality of frets provided on said finger-board;

tone-pitch designating means for designating a tone pitch corresponding to a fret position on which fingering operation is executed, when fingering operation is executed on said plurality of frets; and tone-color assigning means for dividing said fingering areas on the basis of a particular fret among said plurality of frets, and for assigning specific tone colors to the divided fingering areas, respectively.

10. An electronic musical instrument according to claim 9, further comprising:

string-vibration detecting means for detecting vibration of said string; and control means for controlling to cause to generate a musical tone having one of tone colors which have been assigned to respective fingering areas by said tone-color assigning means, in response to the vibration of said string detected by said string vibration detecting means.

11. An electronic musical instrument according to claim 9, further comprising:

selection means for deciding whether said tone-color assigning means assigns different tone colors to said fingering areas, respectively or said tone-color assigning means assigns the same kind of tone color to said respective fingering areas.

12. An electronic musical instrument according to claim 9, further comprising:

setting means for setting a position of said particular fret.

13. An electronic musical instrument comprising:

a finger board having a plurality of fingering areas which are arranged in parallel;

a plurality of strings extended longitudinally along said fingering areas;

a plurality of frets provided on said finger-board, and arranged at predetermined intervals and at right angles to the longitudinal direction of said fingering areas;

tone-pitch designating means for designating a tone pitch corresponding to fret position where fingering operation is executed, in response to fingering operation on said plurality of strings; and tone-color assigning means for dividing said fingering areas on the basis of one or more particular frets among a plurality of said frets and for assigning same or different tone colors to the divided fingering areas, respectively.

14. An electronic musical instrument according to claim 12, further comprising:

string-vibration detecting means for detecting vibrations of said respective strings; and control means for controlling to cause to generate a musical tone having one of the tone colors which said tone color assigning means assigns to said fingering areas, in response to the vibration detected by said string vibration detecting means.

15. An electronic musical instrument according to claim 12, further comprising:

selection means for deciding whether said tone-color assigning means assigns different tone colors to said fingering areas, respectively or said tone-color assigning means assigns the same kind of tone color to said respective fingering area.

16. An electronic musical instrument according to claim 12, further comprising:

setting means for setting a position of said particular fret.

* * * * *